US010130151B2

(12) United States Patent
Lai

(10) Patent No.: US 10,130,151 B2
(45) Date of Patent: Nov. 20, 2018

(54) HARD-SHELL LUGGAGE WITH COMBINATION OF SHELLS AND RING FRAMES

(71) Applicant: Wei-Hung Lai, Taichung (TW)

(72) Inventor: Wei-Hung Lai, Taichung (TW)

( * ) Notice: Subject to any disclaimer, the term of this patent is extended or adjusted under 35 U.S.C. 154(b) by 0 days.

(21) Appl. No.: 15/377,442

(22) Filed: Dec. 13, 2016

(65) Prior Publication Data

US 2018/0160785 A1 Jun. 14, 2018

(51) Int. Cl.
*A45C 13/04* (2006.01)
*A45C 5/03* (2006.01)

(52) U.S. Cl.
CPC ..... *A45C 13/04* (2013.01); *A45C 5/03* (2013.01); *A45C 2005/037* (2013.01)

(58) Field of Classification Search
CPC .... A45C 2005/037; A45C 13/04; A45C 13/08
USPC ..... 190/24, 122
See application file for complete search history.

(56) References Cited

U.S. PATENT DOCUMENTS

| | | | | | |
|---|---|---|---|---|---|
| 3,432,012 | A * | 3/1969 | Winter | A45C 5/02 | 190/122 |
| 3,513,951 | A * | 5/1970 | Leong | A45C 5/02 | 190/115 |
| 3,780,838 | A * | 12/1973 | Slan | A45C 5/02 | 190/121 |
| 4,509,622 | A * | 4/1985 | Morszeck | A45C 13/10 | 190/119 |
| 5,007,510 | A * | 4/1991 | Houng | A45C 5/02 | 190/122 |
| 5,685,403 | A * | 11/1997 | Morszeck | A45C 5/02 | 190/126 |
| 6,050,373 | A | 4/2000 | Wonka | | |
| 9,380,845 | B2 | 7/2016 | Sheikh et al. | | |
| 2003/0221925 | A1* | 12/2003 | Pfeiffer | A45C 13/04 | 190/107 |
| 2016/0166024 | A1 | 6/2016 | Lai | | |

* cited by examiner

*Primary Examiner* — Sue A Weaver
(74) *Attorney, Agent, or Firm* — Wang Law Firm, Inc.

(57) ABSTRACT

A hard-shell luggage includes two shells connected together to form a storage space therein. Each of the shells has a rigid panel and an annular frame connected together. Two stop mechanisms are provided on the shells to be abutted against the rigid panels respectively to stop a movement of the panels so as to increase a structural strength of the luggage.

4 Claims, 8 Drawing Sheets

HARD-SHELL LUGGAGE WITH COMBINATION OF SHELLS AND RING FRAMES

BACKGROUND OF THE INVENTION

1. Technical Field

The present invention relates to a luggage, and more particularly to a hard-shell luggage with a combination of shells and ring frames.

2. Description of Related Art

Typically, luggages are classified into hard-shell luggages and soft-shell luggages. The hard-shell luggages have high capacity of anti-deformation. In other words, the hard-shell luggages could take larger impact than the soft-shell luggages to protect goods stored therein.

U.S. Pat. No. 9,380,845 disclosed a luggage with a hard-shell case. The case has a design panel, and has a rim portion. This patent fails to disclose how the case is connected to the rim.

U.S. Pat. No. 6,050,373 disclosed a luggage having two pivoted frames and two shells are mounted in the frames respectively. This patent fails to disclose any mechanism to stop the shells.

US 2016/0166024 disclosed a luggage having a shell consisting of a frame and a panel. The panel is connected to the frame via fasteners. This patent still fails to disclose any mechanism to stop the shells. Besides, the fasteners are parallel to the panel, so that the fasteners couldn't stop the shells.

BRIEF SUMMARY OF THE INVENTION

In view of the above, the primary objective of the present invention is to provide a hard-shell luggage, which has great connection strength of the shells and the ring frames to reduce the risk of a shift of the shell when the luggage is impacted.

In order to achieve the objective of the present invention, a hard-shell luggage includes a first shell having a first panel and a first ring frame connected to the first panel; a second shell having a second panel and a second ring frame connected to the second panel, wherein the first shell is connected to the second shell to form a storage space therein; a first stop mechanism connected to the first ring frame to be abutted against an edge of the first panel to stop a movement toward the storage space of the first panel; and a second stop mechanism connected to the second ring frame to be abutted against an edge of the second panel to stop a movement toward the storage space of the second panel.

In an embodiment, the first and the second stop mechanisms each has an annular rib formed on an inner side of the first and the second ring frames respectively. The annular ribs extend toward the storage space respectively.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
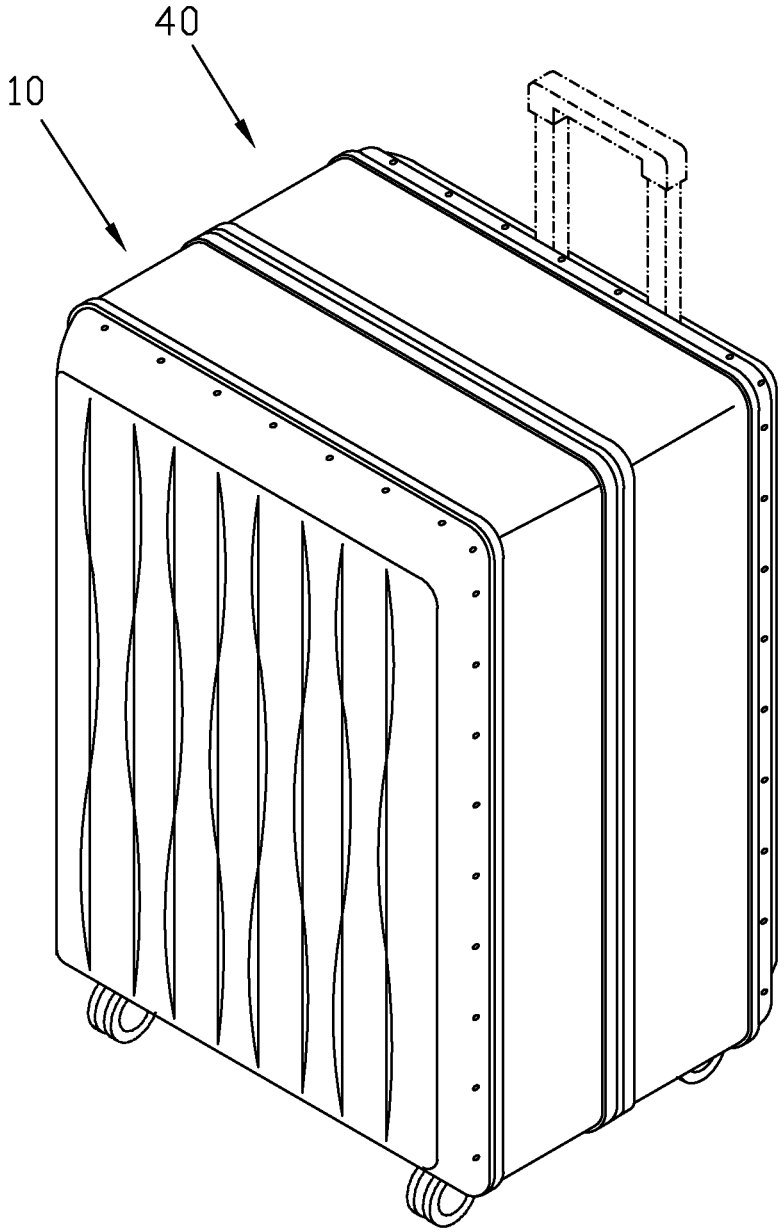
FIG. 1 is a perspective view of a first preferred embodiment of the present invention.
Figure 2:
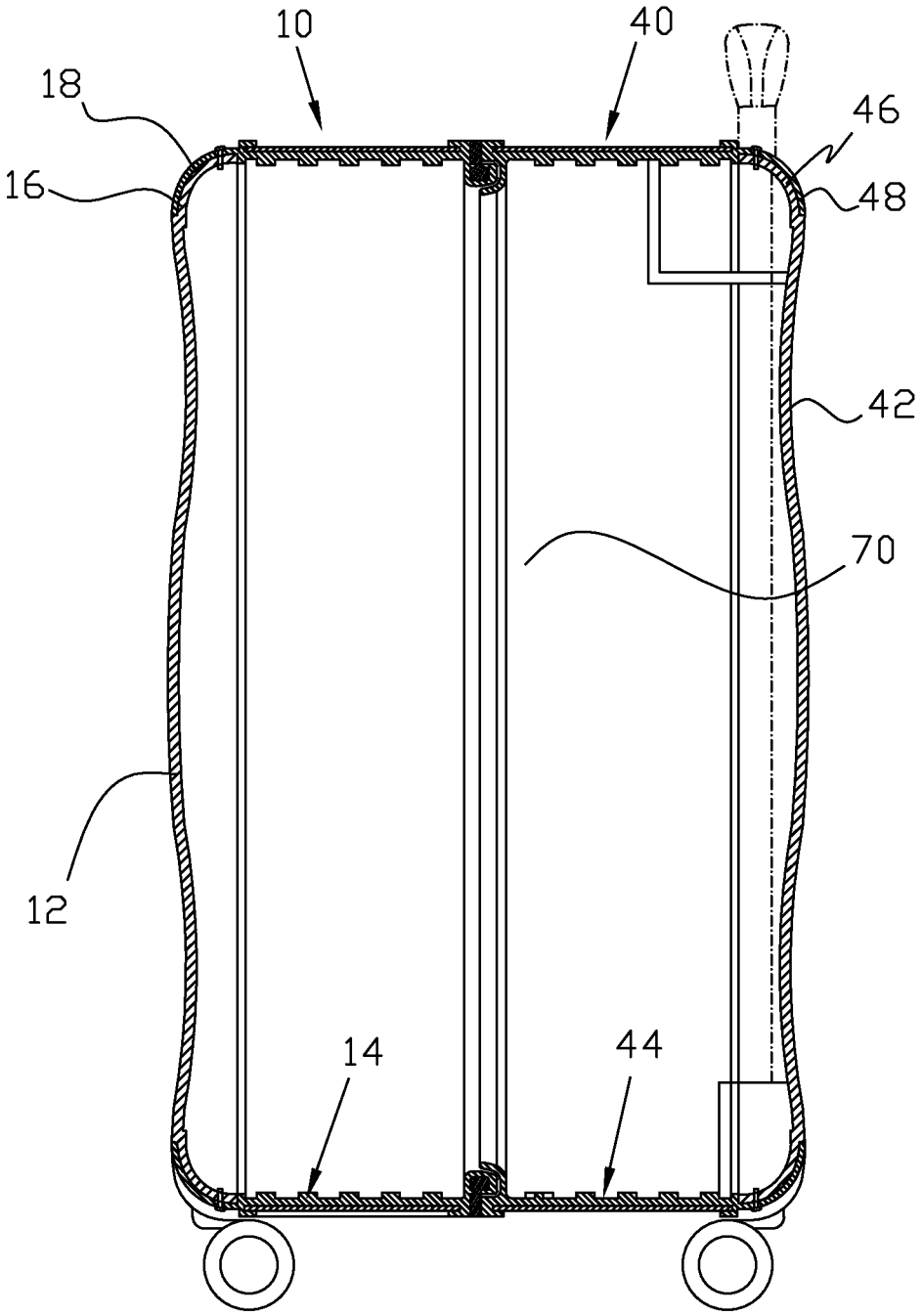
FIG. 2 is a sectional view of the first preferred embodiment of the present invention.

As shown in FIGS. 1 and 2, a luggage of the first preferred embodiment of the present invention includes a first shell 10, a second shell 40, a first stop mechanism 24, and a second stop mechanism 54. The first and the second shells 10 and 40 could be moved toward each other to a closed position, and moved away from each other to an opened position. A storage space 70 (FIG. 2) is formed in the first and the second shells 10 and 40.

Figure 3:
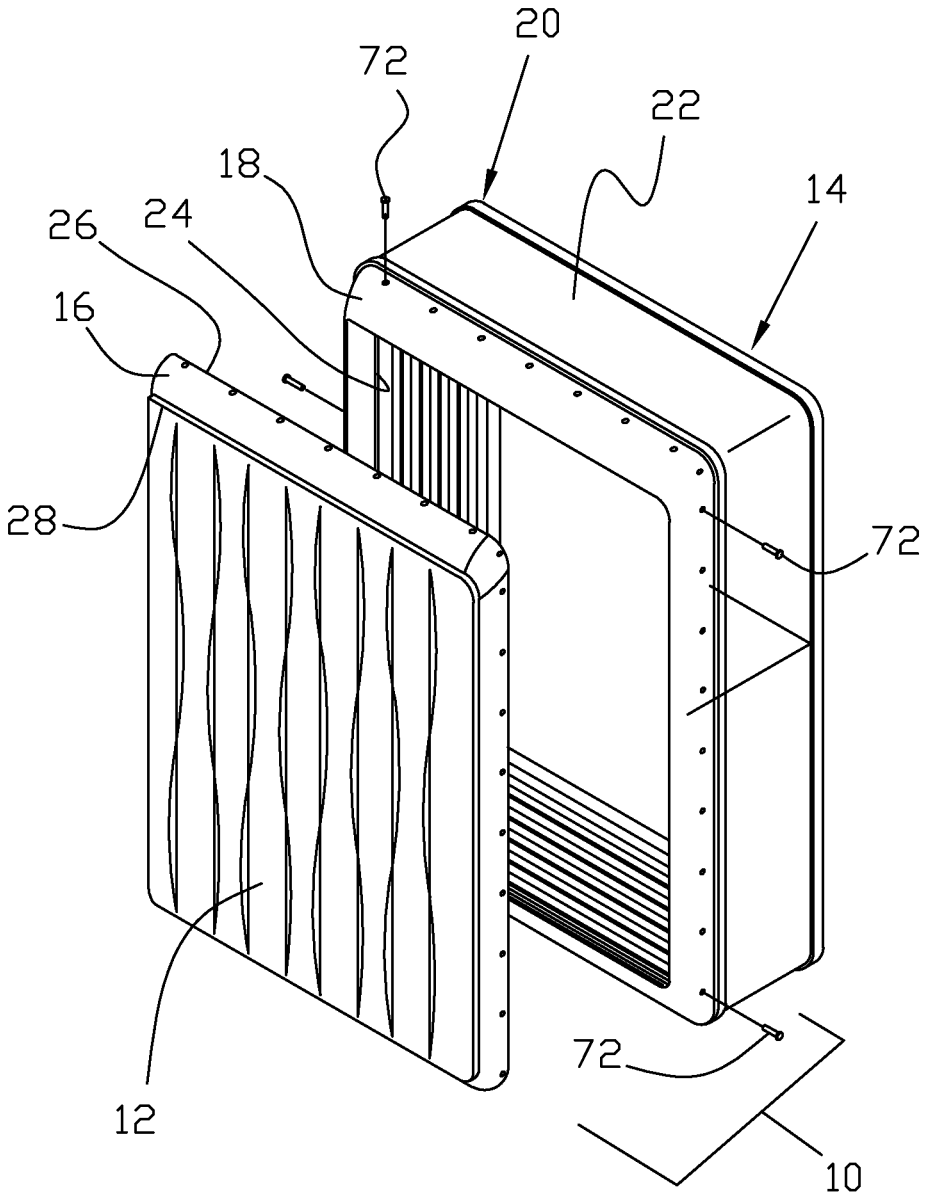
FIG. 3 is an exploded view of the first shell of the first preferred embodiment of the present invention.

As shown in FIGS. 2 and 3, the first shell 10 has a first panel 12 and a first ring frame 14 connected to the first panel 12, wherein the first panel 12 is made of a hard material, and the first ring frame 14 is made of metal. The first panel 12 has a first curved plate portion 16 at a margin thereof, and the first ring frame 14 has a first curved frame portion 18 at an edge thereof. The first curved frame portion 18 of the first ring frame 14 is attached to the first curved plate portion 16, with portions overlapped, to connect the first panel 12 to the first ring frame 14.

Figure 4:
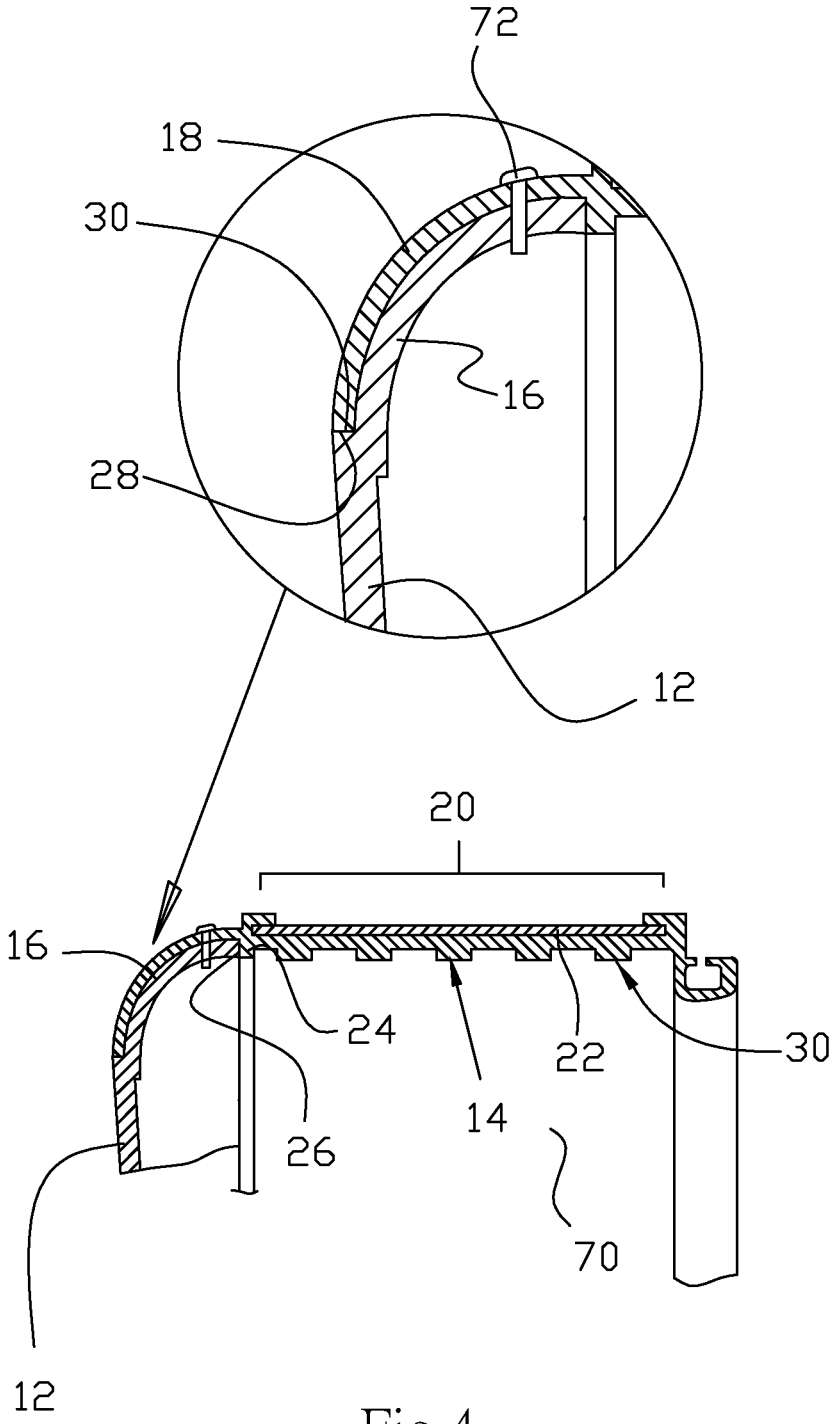
FIG. 4 is a sectional view and an enlarged view of the first shell of the first preferred embodiment of the present invention.

As shown in FIGS. 3 and 4, the first ring frame 14 has a first connecting portion 20 and a first decorating piece 22 on an outer side thereof. The first connecting portion 20 is an elongated protrusion on the outer side (FIG. 4) and extending to the entire first ring frame 14. The first decorating piece 22 engages the first ring frame 14, so that the first decorating piece 22 surrounds the outer side of the first ring frame 14.

The first stop mechanism 24 is connected to the first ring frame 14 to stop the first panel to move inwards. The first stop mechanism 24 is an annular rib formed on an inner side of the first ring frame 14. The first stop mechanism 24 extends toward the storage space 70. The first stop mechanism 24 is abutted against an edge 26 of the first curved plate portion 16 of the first shell 12 when the first panel 12 is connected to the first ring frame 14.

The first panel 12 has a first shoulder portion 28 at the outer side thereof. An edge 30 of the first curved frame portion 18 is abutted against the first shoulder portion 28 when the first curved frame portion 18 is attached to the first curved plate portion 16.

Figure 5:
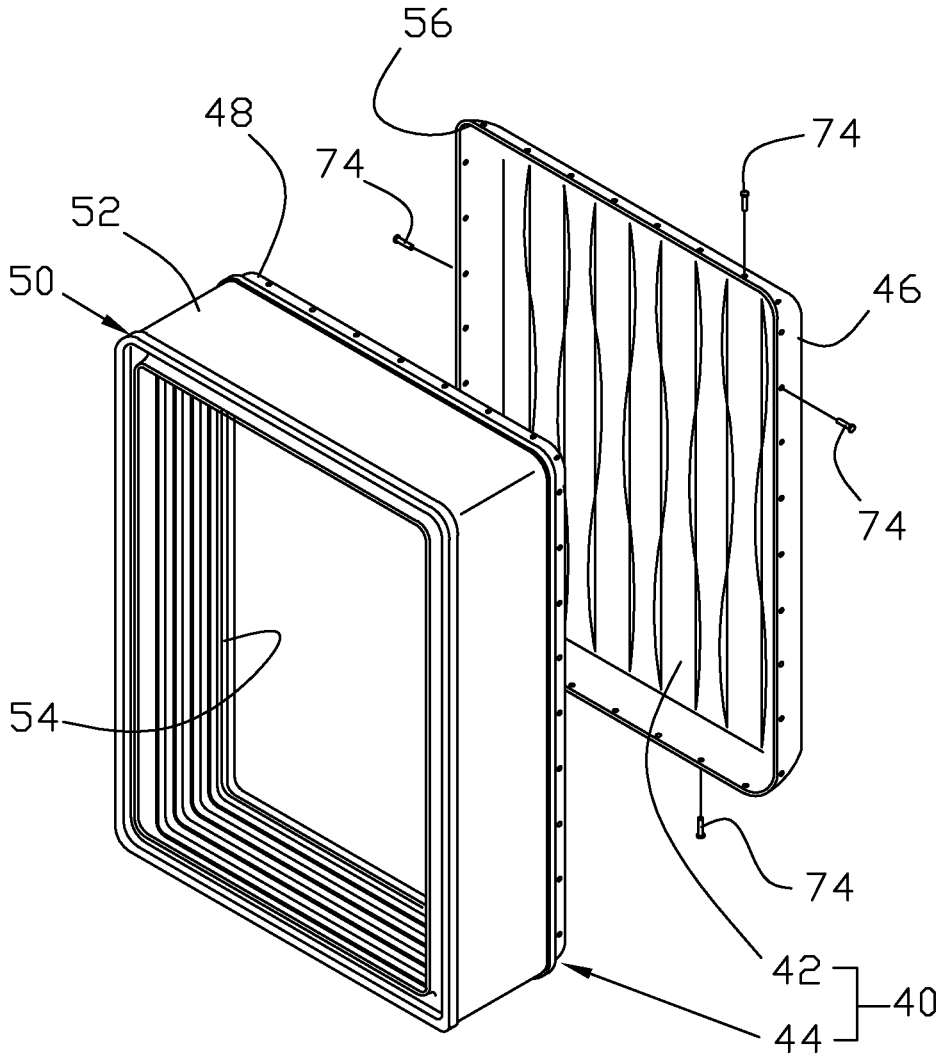
FIG. 5 is an exploded view of the second shell of the first preferred embodiment of the present invention.
Figure 6:
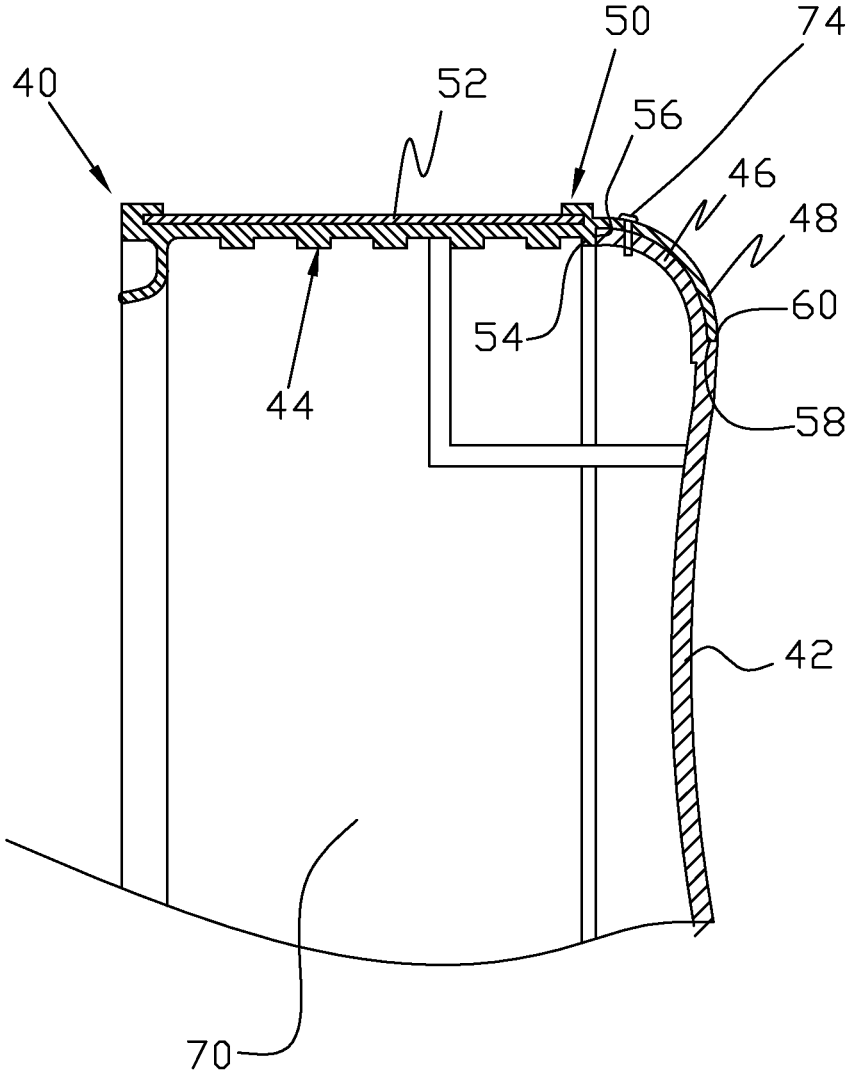
FIG. 6 is a sectional view and an enlarged view of the second shell of the first preferred embodiment of the present invention.

As shown in FIGS. 2, 5, and 6, the second shell 40 has a second panel 42 and a second ring frame 44 connected to the second panel 42, wherein the second panel 42 is made of a hard material, and the second ring frame 44 is made of metal.

The second panel 42 has a second curved plate portion 46 at a margin thereof, and the second ring frame 44 has a second curved frame portion 48 at an edge thereof. The second curved frame portion 48 of the second ring frame 44 is attached to the second curved plate portion 46 of the second panel 42, with portions overlapped, to connect the second panel 42 to the second ring frame 44.

As shown in FIGS. 5 and 6, the second ring frame 44 has a second connecting portion 50 and a second decorating piece 52 on an outer side thereof. The second connecting portion 50 is an elongated protrusion on the outer side (FIG. 4) and extending to the entire second ring frame 44. The second decorating piece 52 engages the second ring frame 44, so that the second decorating piece 52 surrounds the outer side of the second ring frame 44.

The second stop mechanism 54 is connected to the second ring frame 44 to stop the second panel to move inwards. The second stop mechanism 54 is an annular rib formed on an inner side of the second ring frame 44. The second stop mechanism 54 extends toward the storage space 70. The second stop mechanism 54 is abutted against an edge 56 of the second curved plate portion 46 of the second shell 42 when the second panel 42 is connected to the second ring frame 44.

The second panel 42 has a second shoulder portion 58 at the outer side thereof. An edge 60 of the second curved frame portion 48 is abutted against the second shoulder portion 58 when the second curved frame portion 48 is attached to the second curved plate portion 46.

As shown in FIGS. 4 and 6, the first stop mechanism 24 is abutted against the edge 26 of the first curved plate portion 16 of the first panel 12, and the second stop mechanism 54 is abutted against the edge 56 of the second curved plate portion 46 of the second panel 42, so that the first and the second panels 12, 42 will be secured firmly even when the first and/or the second panels 12, 42 is impacted to increase a structure strength of the luggage.

The first decorating piece 22 engages the first connecting portion 20 of the first ring frame 14, and the second decorating piece 52 engages the second connecting portion 50 of the second ring frame 44. Therefore, widths of the first and the second ring frames 14, 44 are enlarged, and the structure strength of the luggage is increased. The first decorating piece 22 could have the same color and material as the first panel 12, and the second decorating piece 52 could have the same color and material as the second panel 42 as well, as a result, the entire luggage has a single color and material.

The first and the second shoulder portions 28, 58 are abutted against the edges 30, 60 of the first and the second curved frame portions 18, 48 respectively. It could make the luggage have an even aspect.

As shown in FIGS. 3 and 4, the luggage further includes a plurality of fasteners 72 passing through an overlapped portion of the first curved plate portion 16 and the first curved frame portion 18. Orientations of the fasteners 72 are parallel to a direction of a possible movement of the first panel 12. The fasteners 72 not only increase the connecting strength of the first panel 12 and the first ring frame 14, but also stop the first panel 12 to move. They make the luggage have large structure strength.

As shown in FIGS. 5 and 6, fasteners 74 passing through an overlapped portion of the second curved plate portion 46 and the second curved frame portion 48 as well. Orientations of the fasteners 74 are parallel to a direction of a possible movement of the second panel 42. The fasteners 74 not only increase the connecting strength of the second panel 42 and the second ring frame 44, but also stop the second panel 42 to move. They make the luggage have great structure strength.

Figure 7:
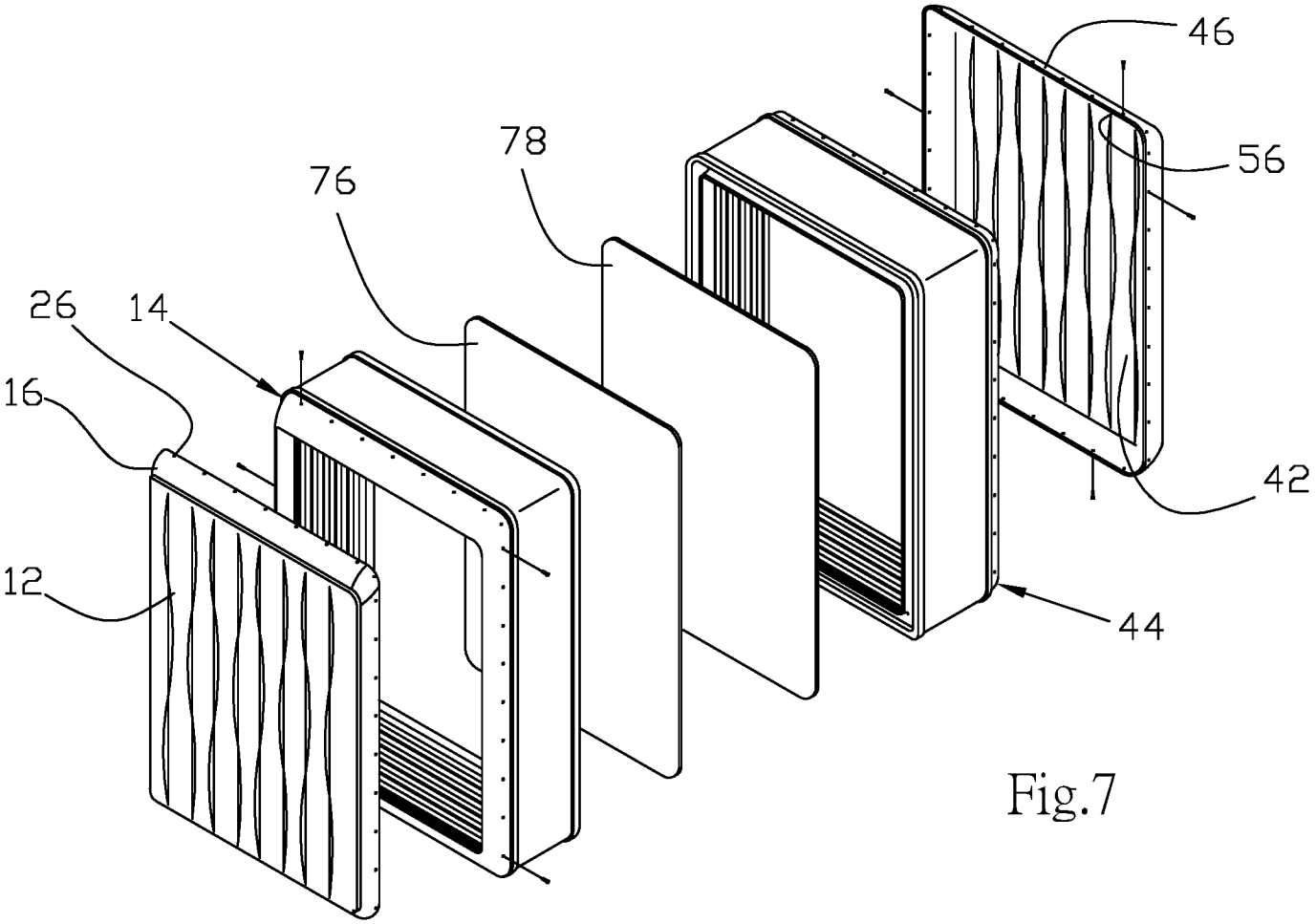
FIG. 7 is a sectional view of a second preferred embodiment of the present invention.
Figure 8:
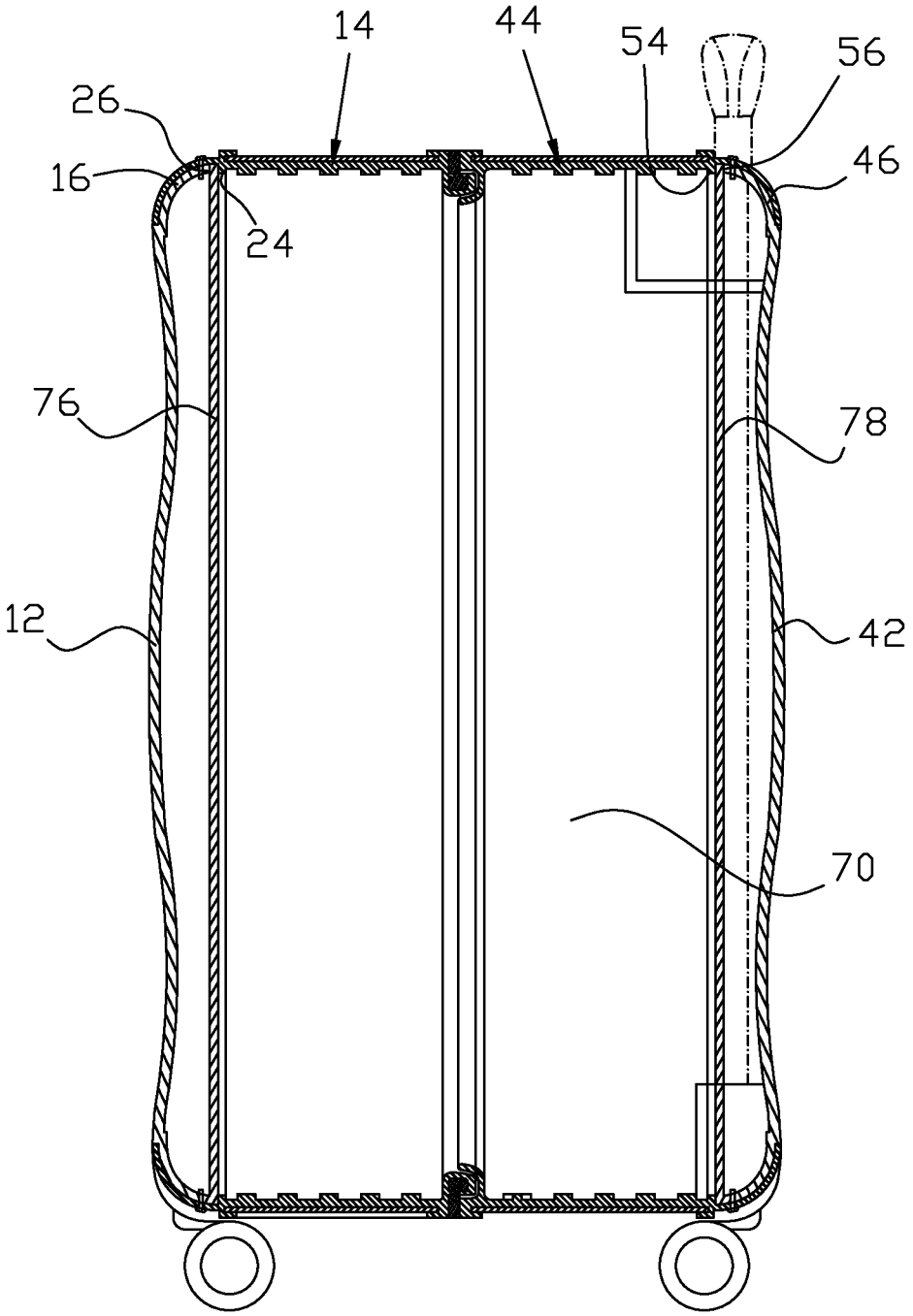
FIG. 8 is a perspective view of the second preferred embodiment of the present invention.

As shown in FIGS. 7 and 8, a luggage of the second preferred embodiment of the present invention further includes a first plate 76 beside the first panel 12. The first plate 76 and the first panel 12 are connected to the first ring frame 14. The edge 26 of the first curved plate portion 16 of the first panel 12 presses the first plate 76 to be abutted against the first stop mechanism 24.

The same as above, a second plate 78 is provided beside the second panel 42. The second plate 78 and the second panel 42 are connected to the second ring frame 44. The edge 56 of the second curved plate portion 46 of the second panel 42 presses the second plate 78 to be abutted against the second stop mechanism 54.

In conclusion, the first and the second stop mechanism 24, 54 may stop the possible movement of the first plate 76 and the first panel 12 as well as the possible movement of the second plate 78 and the second panel 42 respectively.

It must be pointed out that the embodiments described above are only some preferred embodiments of the present invention. All equivalent structures which employ the concepts disclosed in this specification and the appended claims should fall within the scope of the present invention.

What is claimed is:

1. A hard-shell luggage, comprising:

a first shell;

a second shell connected to the first shell to form a storage space therein;

wherein the first shell has a first panel and a first ring frame; the first panel has a first curved plate portion at a margin thereof, and the first ring frame has a first curved frame portion at an edge thereof; the first curved frame portion is attached to the first curved plate portion;

wherein the second shell has a second panel and a second ring frame; the second panel has a second curved plate portion at a margin thereof, and the second ring frame has a second curved frame portion at an edge thereof; the second curved frame portion is attached to the second curved plate portion;

a first stop mechanism connected to the first ring frame to be abutted against an edge of the first curved plate portion of the first panel to stop a movement of the first panel toward the storage space; and a second stop mechanism connected to the second ring frame to be abutted against an edge of the second curved plate portion of the second panel to stop a movement of the second panel toward the storage space;

wherein the first panel has a first shoulder portion at the outer side thereof; the first curved plate portion has a portion overlapped with the first curved frame portion; an edge of the first curved frame portion is abutted against the first shoulder portion; the second panel has a second shoulder portion at the outer side thereof; the second curved plate portion has a portion overlapped with the second curved frame portion; an edge of the second curved frame portion is abutted against the second shoulder portion.

2. The hard-shell luggage of claim 1, wherein the first stop mechanism has an annular rib formed on an inner side of the first ring frame and extending toward the storage space, and the second stop mechanism has an annular rib formed on an inner side of the second ring frame and extending toward the storage space.

3. The hard-shell luggage of claim 1, further comprising a plurality of fasteners passing through an overlapped portion of the first curved frame portion and the first curved plate portion, and an overlapped portion of the second curved frame portion and the second curved plate portion respectively; orientations of the fasteners are parallel to directions of the movements of the first panel and the second panel respectively.

4. The hard-shell luggage of claim 1, wherein the first shell further includes a first decorating piece connected to a first connecting portion on an outer side of the first ring frame, and the second shell further includes a second decorating piece connected to a second connecting portion on an outer side of the second ring frame; the first connecting portion has an elongated protrusion on the outer side of the first ring frame to engage the first decorating piece, and the second connecting portion has an elongated protrusion on the outer side of the second ring frame to engage the second decorating piece.

* * * * *